US008439213B2

(12) United States Patent
Goria et al.

(10) Patent No.: US 8,439,213 B2
(45) Date of Patent: May 14, 2013

(54) SECURITY CLOSURE ASSEMBLY FOR A CONTAINER, IN PARTICULAR FOR A BOTTLE FOR LIQUIDS

(75) Inventors: Francesco Goria, San Damiano D'Asti (IT); Fabio Caporaletti, Carbonara Scrivia (IT); Flavio Rainero, Vaglierano Frazione De Asti (IT)

(73) Assignee: Alplast S.p.A., Turin (IT)

( * ) Notice: Subject to any disclaimer, the term of this patent is extended or adjusted under 35 U.S.C. 154(b) by 328 days.

(21) Appl. No.: 12/864,806

(22) PCT Filed: Jan. 27, 2009

(86) PCT No.: PCT/IB2009/050323

§ 371 (c)(1), (2), (4) Date: Jul. 27, 2010

(87) PCT Pub. No.: WO2009/095851

PCT Pub. Date: Aug. 6, 2009

(65) Prior Publication Data

US 2010/0308054 A1 Dec. 9, 2010

(30) Foreign Application Priority Data

Jan. 31, 2008 (IT) ..... TO2008A0067

(51) Int. Cl.

| | |
|---|---|
| ***B65D 41/00*** | (2006.01) |
| ***B65D 41/62*** | (2006.01) |
| ***B65D 41/04*** | (2006.01) |

(52) U.S. Cl.

USPC ..... 215/277; 215/252; 215/258; 215/273; 215/329

(58) Field of Classification Search ..... 215/14, 215/217, 252, 258, 273, 277, 329, 334, 352; 220/315

See application file for complete search history.

(56) References Cited

U.S. PATENT DOCUMENTS

| | | | | |
|---|---|---|---|---|
| 6,276,544 | B1 * | 8/2001 | Battegazzore | 215/252 |
| 8,181,803 | B2 * | 5/2012 | Torrent Ortega | 215/352 |
| 2005/0115915 | A1 * | 6/2005 | Thomson | 215/252 |

FOREIGN PATENT DOCUMENTS

| | | | |
|---|---|---|---|
| EP | 1 511 677 | A1 | 3/2005 |
| EP | 1 574 450 | A1 | 9/2005 |
| WO | 98/55370 | A1 | 12/1998 |
| WO | 02/096771 | A1 | 12/2002 |
| WO | 03/104100 | A1 | 12/2003 |
| WO | 2004/065248 | A1 | 8/2004 |

* cited by examiner

*Primary Examiner* — Anthony Stashick
*Assistant Examiner* — Madison L Poos
(74) *Attorney, Agent, or Firm* — Sughrue Mion, PLLC

(57) ABSTRACT

The closure assembly (1) comprises: a pourer unit (2) having a lower portion (3) for fixing to the mouth of the container and an upper pouring portion (4), a removable cap (6) provided with a resiliently deformable peripheral lip portion (7), and an outer covering (8, 9) including: an upper sleeve element (8) and a lower sleeve element (9. The arrangement is such that, after the first opening of the closure assembly (1), the lip portion (7) is arranged in the opened-out condition in which it extends radially outside of the lower sleeve element (9) but permits subsequent re-fitting of the cap (6) on the pourer unit (2) as far as the closure position in which the lower sleeve element (9) and the upper sleeve element (8) once more extend the predetermined distance (d) apart.

4 Claims, 5 Drawing Sheets

Figure 1:
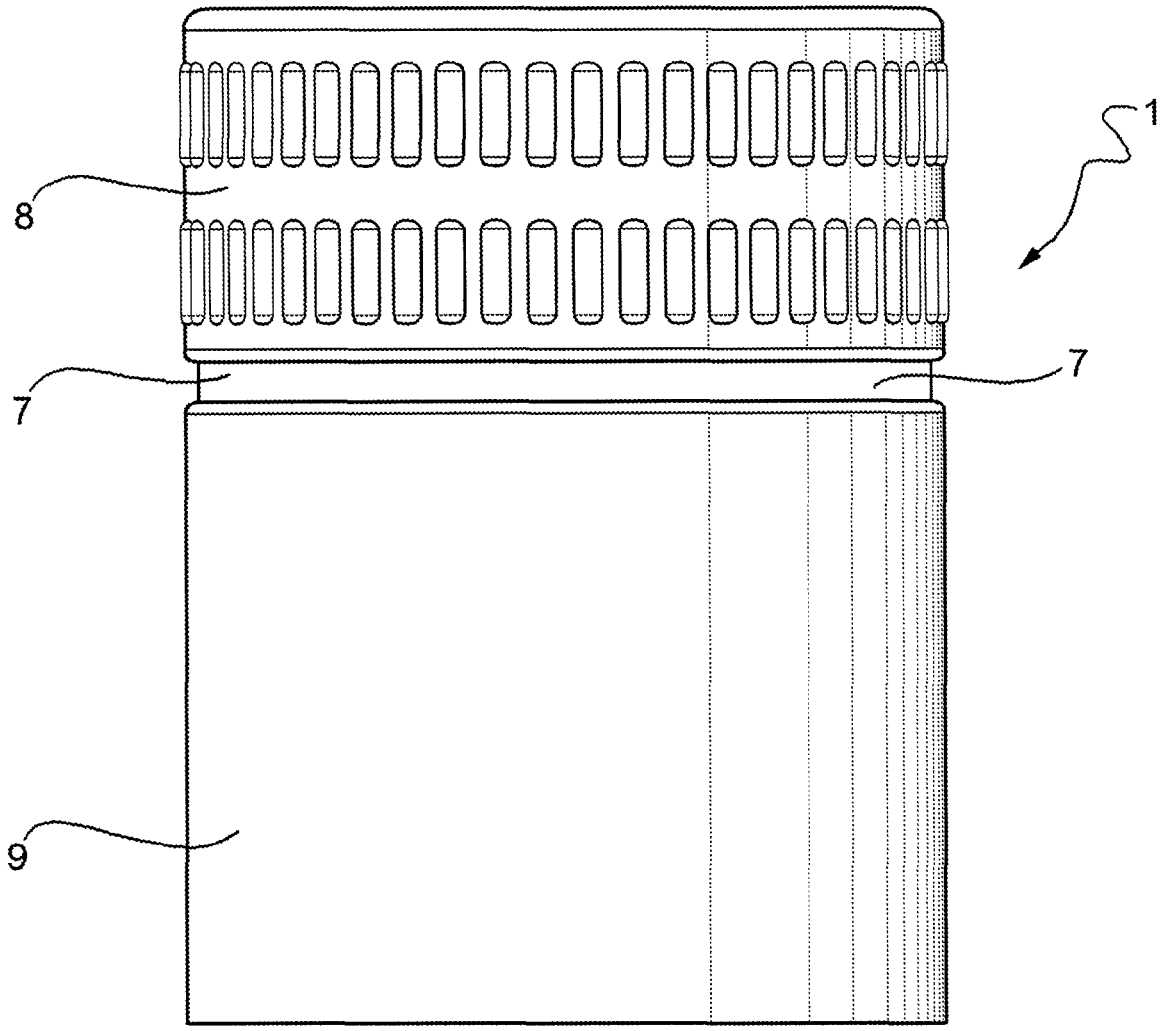

SECURITY CLOSURE ASSEMBLY FOR A CONTAINER, IN PARTICULAR FOR A BOTTLE FOR LIQUIDS

CROSS REFERENCE TO RELATED APPLICATIONS

This application is a National Stage of International Application No. PCT/IB2009/050323 filed Jan. 27, 2009, claiming priority based on Italian Patent Application No. TO2008A000067 filed Jan. 31, 2008, the contents of all of which are incorporated herein by reference in their entirety.

The present invention relates to a security closure assembly for the mouth of a container, in particular a bottle for liquids.

More specifically, the subject of the invention is a security closure assembly of the so-called "tamper-evident" type, comprising:

- a pourer unit having a lower portion for fixing to the mouth of the container and an upper pouring portion,
- a removable cap which can be fitted onto the pourer unit as far as a closure position in which the cap is in abutment with a stop surface, the cap having at least one resiliently deformable peripheral lip portion, and
- an outer covering including:
- an upper sleeve element which closely surrounds the cap leaving the lip portion thereof substantially exposed, and
- a lower sleeve element which is separate from the upper sleeve element and closely surrounds the lower portion of the pourer unit and which, prior to the first opening of the closure assembly, extends at a predetermined distance from the upper sleeve element and at least partially surrounds the lip portion of the cap,
- the arrangement being such that, after the first opening of the closure assembly, that is, the first disconnection of the cap from the pourer unit, the lip portion is released from the lower sleeve element and, upon subsequent re-closure, extends outside the lower sleeve element and indicates that the closure assembly has been opened.

A security closure assembly of this type is known, for example, from European patent application EP 1 511 677 A1.

In this closure assembly of the prior art, after the first opening, the lip portion of the cap is released from the lower sleeve element of the outer covering and, upon subsequent re-closure of the closure assembly, the lip portion is interposed between the upper sleeve element and the lower sleeve element, in fact keeping them further apart than they were originally.

An object of the present invention is to provide an improved security closure assembly of this type which provides a visible indication that the closure assembly has been opened but which, at the same time, permits effective and secure re-closure of the closure assembly after the first opening and every subsequent re-opening.

This and other objects are achieved according to the invention, by a security closure assembly of the type specified above, characterized in that the at least one lip portion is biased towards a condition in which it is opened out radially and, prior to the first opening of the closure assembly, the lower sleeve element of the outer covering keeps the lip portion in a condition in which it is drawn in resiliently towards the longitudinal axis of the closure assembly,

- the arrangement being such that, after the first opening of the closure assembly, the lip portion is arranged in the opened-out condition in which it extends at least partially radially outside of the lower sleeve element so as to permit subsequent re-fitting of the cap on the pourer unit as far as the closure position in which the lower sleeve element and the upper sleeve element once more extend the predetermined distance apart.

Figure 4:
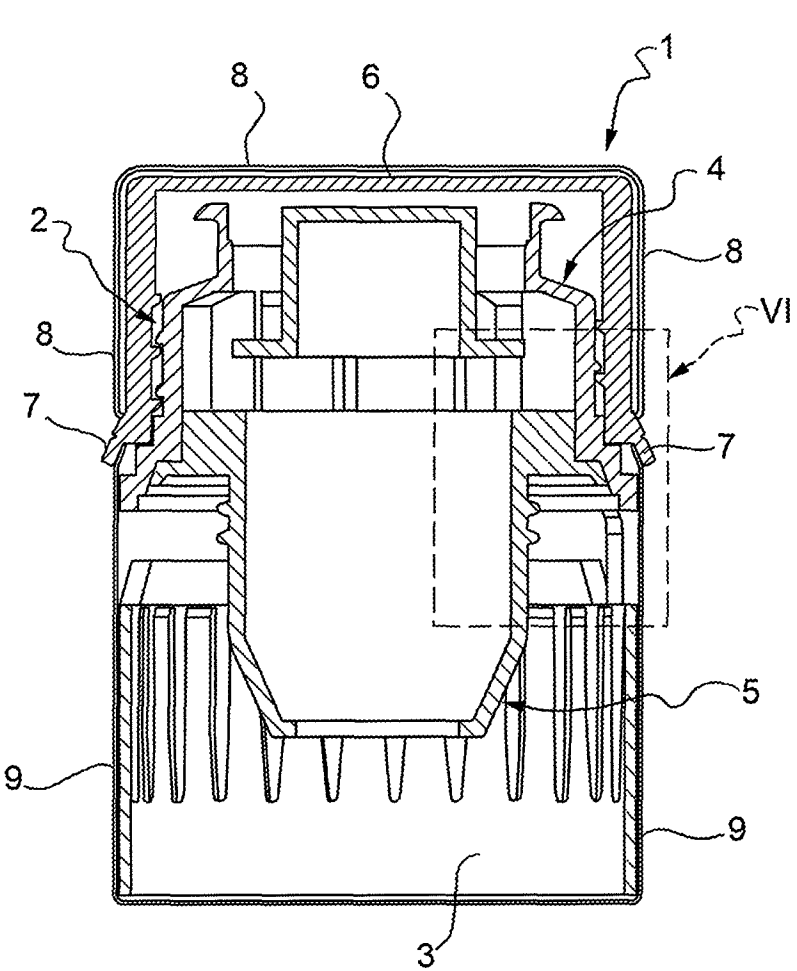
Figure 2:
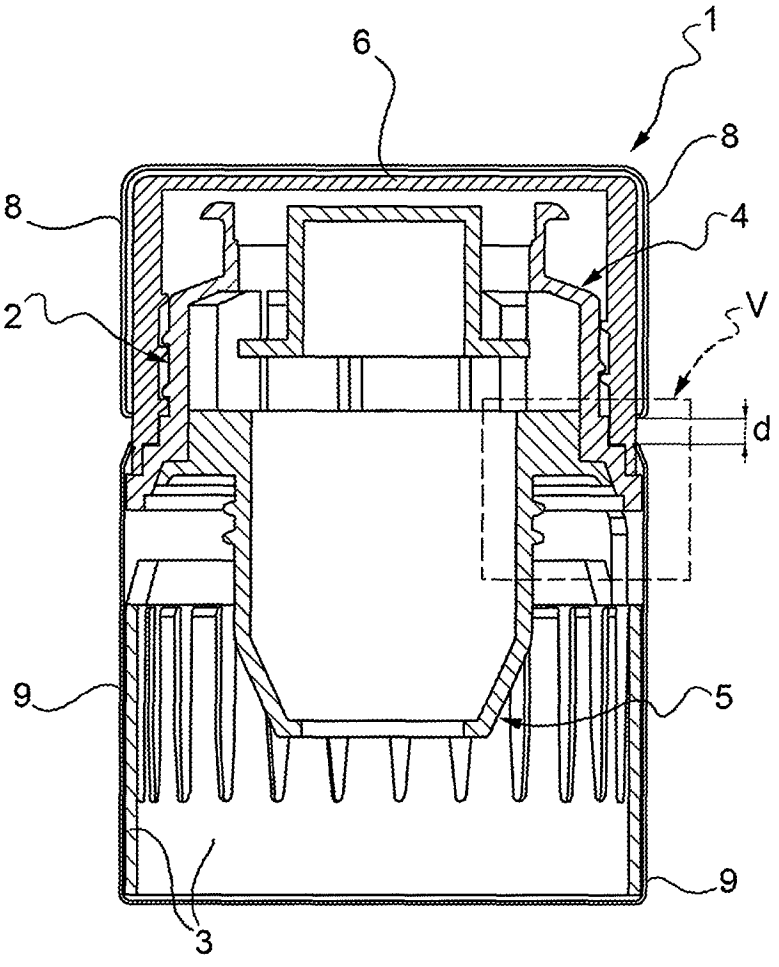
Figure 3:
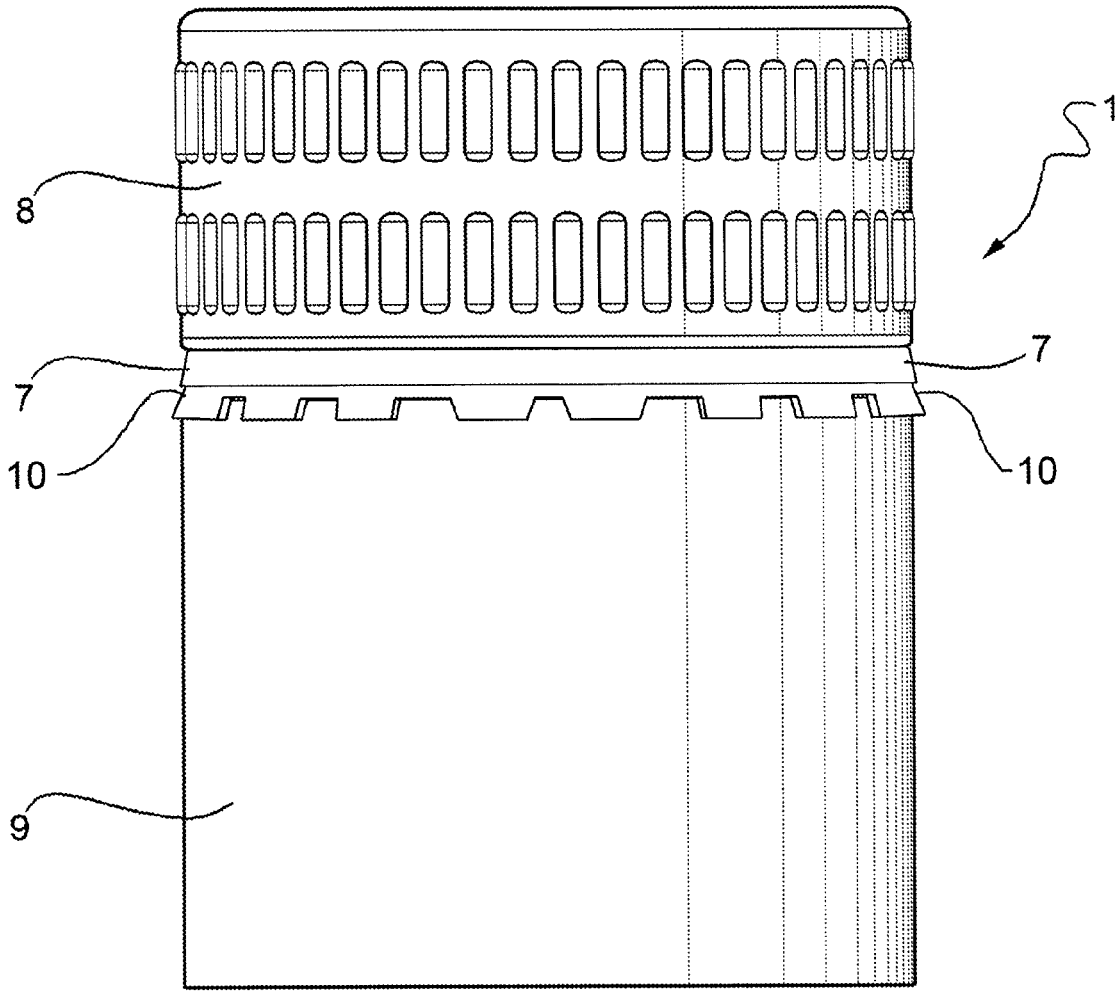
Figure 5:
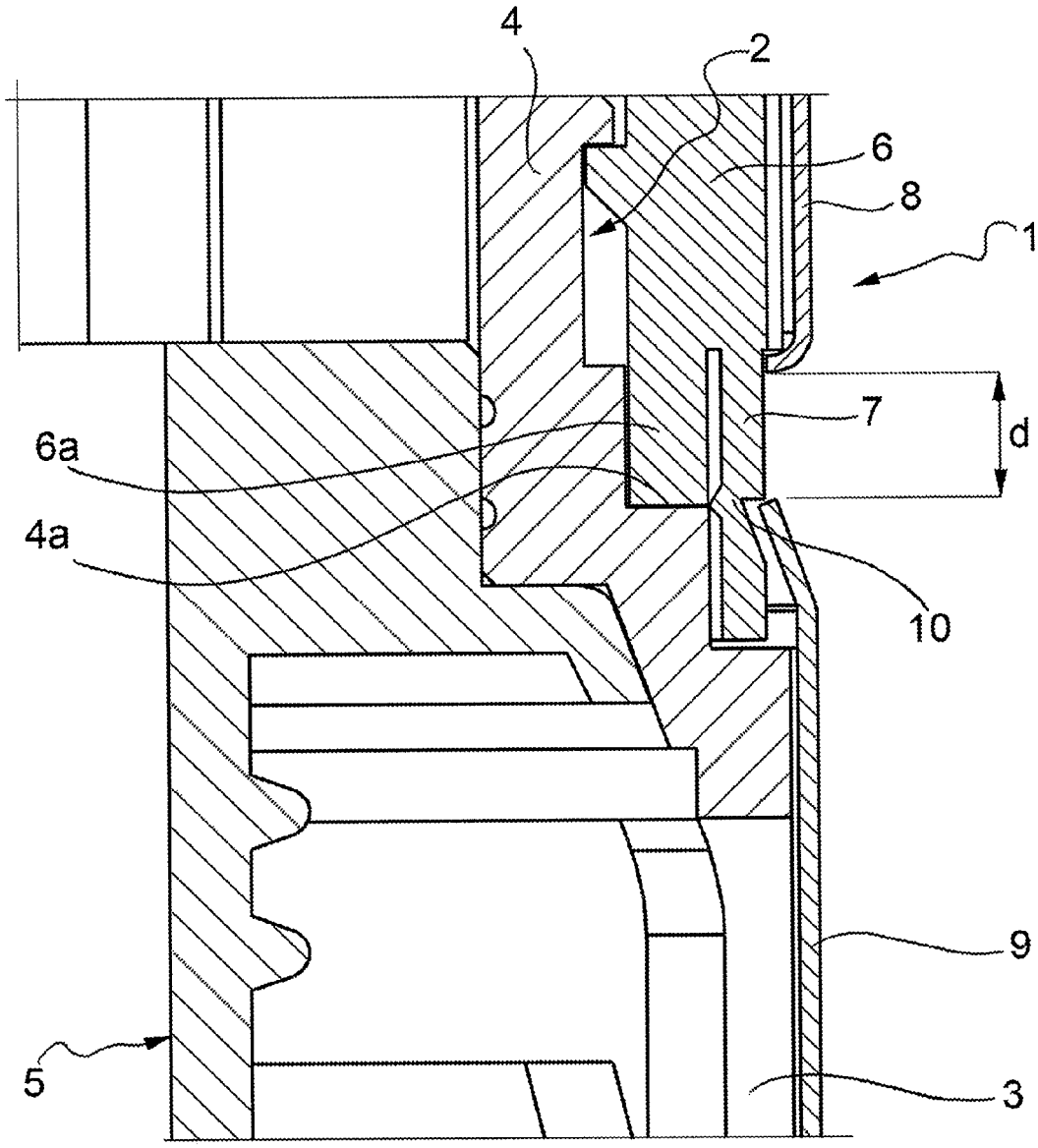
Figure 6:
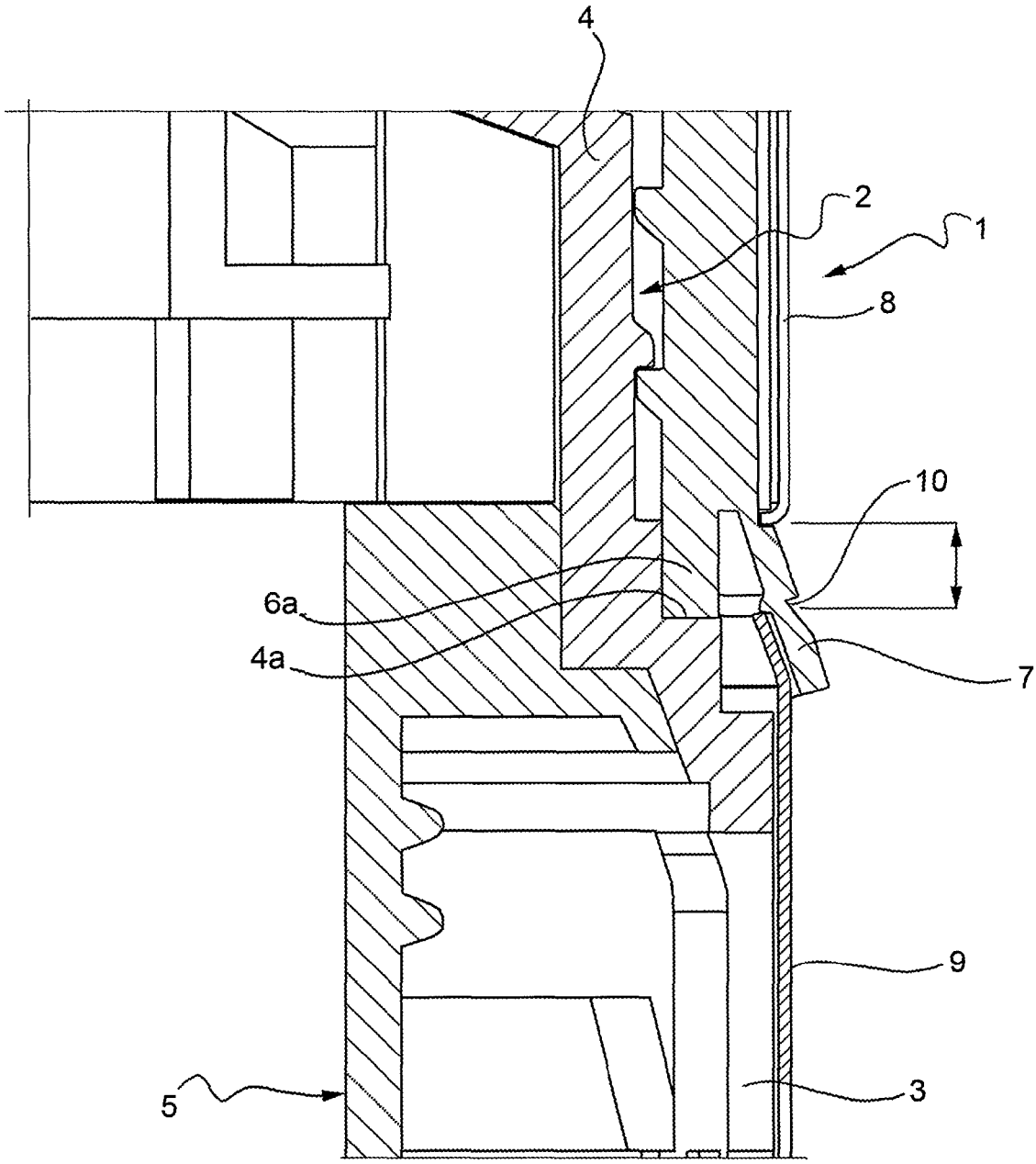

Further characteristics and advantages of the invention will become clear from the following detailed description which is given purely by way of non-limiting example, with reference to the appended drawings, in which:

FIG. 1 is an elevational view of a security closure assembly according to the invention shown in the original condition, that is, prior to its first opening, FIG. 2 is an axial section through the security closure assembly shown in FIG. 1, FIG. 3 is an elevational view of the closure assembly of the preceding drawings, shown in the re-closed condition after the first opening or a subsequent opening, FIG. 4 is a section through the closure assembly shown in FIG. 3, and FIGS. 5 and 6 are partial sections showing, on an enlarged scale, portions indicated V and VI in FIGS. 2 and 4, respectively.

A security closure assembly according to the invention to be fitted on the mouth of a container (not shown), in particular a bottle for liquids, is generally indicated 1 in FIGS. 1 and 2.

With reference to FIG. 2 in particular, the closure assembly 1 comprises a conventional pourer unit, generally indicated 2. The unit comprises a lower portion 3 for fixing on the mouth of the container and an upper pouring portion 4.

A non-return valve device 5 (a device for preventing refilling), which is shown only partially, is associated with the pourer unit 2 in known manner to allow the liquid held in the container with which the closure assembly 1 is associated to be poured out but to prevent the container from being refilled with other liquid admitted through the closure assembly.

The closure assembly 1 further comprises a removable cap 6 which can close the upper pouring portion of the pourer unit 2 in a liquid-tight manner. The cap 6 can be screwed onto and unscrewed from the pourer unit. In the embodiment shown, the pourer unit 2 has, on its upper portion 4, an external thread with which a corresponding internal thread of the cap 6 engages.

When the cap 6 is fully closed, a lower peripheral edge **6*a* thereof bears against a stop shoulder 4*a* of the upper portion 4 of the pourer unit 2, as can be seen in FIGS. 5 and 6 in particular. With reference to FIGS. 2 to 6, the cap 6 has a peripheral lip portion, indicated 7, around the lower edge 6*a*. The lip portion is resiliently deformable and, in the absence of external stresses, is arranged in a condition in which it is opened out radially as shown in FIGS. 3, 4 and 6**.

The lip portion 7 advantageously but not necessarily has, in the intermediate portion of its cross-section, a narrower portion 10 which can act as an integral circumferential hinge for increasing the pliability of the lip portion, particularly during re-closure of the cap 1.

The closure assembly 1 further comprises an outer covering including an upper, cap-like (or at least sleeve-like) element 8 and a lower sleeve-like element 9. The elements 8 and 9 are advantageously made, for example, of a metallic material such as aluminum or an alloy thereof.

The upper cap or sleeve element 8 closely surrounds the cap 6 but leaves the lip portion 7 of the cap substantially exposed.

As can be seen, for example, in FIGS. 1 and 2, the lower sleeve element 9 is separate from the upper sleeve or cap element 8 and closely surrounds the lower portion 3 of the pourer unit 2.

Prior to the first opening of the closure assembly 1, that is, in the condition shown in FIGS. 1, 2 and 5, the lower sleeve element 9 extends at a predetermined distance (which is indicated d and, at the limit, tends towards zero in FIGS. 2 and 5) from the upper sleeve or cap element 8 and also at least partially surrounds the lip portion 7 of the cap 6, keeping it in a condition in which it is drawn in resiliently towards the longitudinal axis of the closure assembly.

The arrangement is such that, after the first opening of the closure assembly 1, that is, the first disconnection of the cap 6 from the pourer unit 2, the lip portion 7 of the cap is released from the lower sleeve element 9 and expands radially, re-adopting its natural opened-out condition in which it extends at least partly radially outside of the lower sleeve element 9.

Upon subsequent reconnection of the cap 6, 8 to the pourer unit 2, the lip portion 7 remains in the radially opened-out condition but does not prevent the cap 6 being screwed on again as far as the closure position in which the lower peripheral edge 6*a* of the cap is brought into abutment with the stop shoulder 4*a* of the pourer unit, as can be seen in FIG. 6 in particular.

In the re-closure condition, after the first opening or any subsequent re-opening, the lip portion 7 naturally remains outside of the lower sleeve element 9 but the cap 6 can be reconnected to the pourer unit 2 so that, in the closure condition, the lower sleeve element 9 and the upper sleeve or cap element 8 are once again spaced apart by substantially the same distance d that separated them prior to the first opening of the cap.

The security cap according to the invention is thus able to indicate in a visually conspicuous manner that the closure assembly 1 has been opened.

The free end edge of the lip portion may be notched as shown in FIG. 3 to enhance the effect of the visual indication that the closure assembly 1 has been opened.

As indicated above, upon each subsequent re-closure, the closure assembly can therefore be re-closed completely, ensuring the same sealing characteristics as the original closure.

The portion of the outer surface of the lip portion 7 which is visible from the exterior prior to the first opening of the closure assembly 1 (FIG. 1) may be made of a different colour from the rest of that surface which becomes visible only after the first opening of the closure assembly 1. For example, the portion of the lip 7 which is visible in the condition of FIG. 1 may be of the same colour as the sleeve elements 8 and 9, whereas the rest of the lip 7 may be red.

The different colouring of the lip 7 may be achieved in various known ways, for example, by painting or by the moulding of plastics material of different colours.

Naturally, the principle of the invention remaining the same, the forms of embodiment and details of construction may be varied widely with respect to those described and illustrated purely by way of non-limiting example, without thereby departing from the scope of the invention as defined in the appended claims.

The invention claimed is:

1. A security closure assembly (1) for a mouth of a container having a longitudinal axis, comprising:

a pourer unit (2) having a lower portion (3) for fixing to the mouth of the container and an upper pouring portion (4);

a removable cap (6) which can be fitted onto the pourer unit (2) as far as a closure position in which the cap (6) is in abutment with a stop surface (4*a*), the cap (6) having at least one resiliently deformable peripheral lip portion (7); and an outer covering (8, 9) including:

an upper sleeve element (8) which closely surrounds the cap (6) leaving the lip portion (7) thereof substantially exposed, and a lower sleeve element (9) which is separate from the upper sleeve element (8) and closely surrounds the lower portion (3) of the pourer unit (2) and which, prior to a first opening of the closure assembly (1), extends at a predetermined distance (d) from the upper sleeve element (8) and at least partially surrounds the lip portion (7) of the cap (6), wherein, after the first opening of the closure assembly (1), that is, a first disconnection of the cap (6) from the pourer unit (2), the lip portion (7) is released from the lower sleeve element (9) and, upon subsequent re-closure, extends outside the lower sleeve element (9) and indicates that the closure assembly (1) has been opened, wherein prior to the first opening of the closure assembly (1), the lower sleeve element (9) of the outer covering (8, 9) keeps the lip portion (7) in a radially compressed condition in which it is drawn in resiliently towards the longitudinal axis of the closure assembly (1), and is resiliently biased towards an opened-out condition in which it is opened out radially, and wherein after the first opening of the closure assembly (1), the lip portion (7) is arranged in the opened-out condition, in which it extends at least partially radially outside of the lower sleeve element (9) so as to permit subsequent re-fitting of the cap (6) on the pourer unit (2) as far as said closure position in which the lower sleeve element (9) and the upper sleeve element (8) once more extend the predetermined distance (d) apart.

2. A closure assembly according to claim 1, wherein the lip portion (7) of the cap (6) has a notched edge.

3. A closure assembly according to claim 1, wherein the lip portion (7) has, in an intermediate portion thereof, an integral circumferential hinge (10).

4. A closure assembly according to claim 1, wherein a portion of the outer surface of the lip portion (7) which is visible from outside prior to the first opening of the closure assembly (1) is of a different colour from the rest of an outer surface of the lip portion (7) which becomes visible from the exterior after the first opening of the closure assembly (1).

* * * * *